US006945800B2

(12) United States Patent
Weight et al.

(10) Patent No.: US 6,945,800 B2
(45) Date of Patent: Sep. 20, 2005

(54) CONSTANT FORCE APPARATUS AND METHOD

(75) Inventors: Brent Weight, Springville, UT (US); Chris A. Mattson, Troy, NY (US); Spencer P. Magleby, Provo, UT (US); Larry L. Howell, Orem, UT (US); Bradford J. Brown, Salem, UT (US)

(73) Assignee: Brigham Young University, Provo, UT (US)

( * ) Notice: Subject to any disclaimer, the term of this patent is extended or adjusted under 35 U.S.C. 154(b) by 0 days.

(21) Appl. No.: 10/450,668

(22) PCT Filed: Dec. 14, 2001

(86) PCT No.: PCT/US01/48188

§ 371 (c)(1),
(2), (4) Date: Jan. 15, 2004

(87) PCT Pub. No.: WO02/49159

PCT Pub. Date: Jun. 20, 2002

(65) Prior Publication Data

US 2004/0137785 A1 Jul. 15, 2004

Related U.S. Application Data

(60) Provisional application No. 60/256,030, filed on Dec. 15, 2000.

(51) Int. Cl.[7] ..... H01R 13/44

(52) U.S. Cl. ..... 439/136; 361/686

(58) Field of Search ..... 361/683–686; 439/136–138, 142, 145, 159, 341, 376

(56) References Cited

U.S. PATENT DOCUMENTS

| | | | | |
|---|---|---|---|---|
| 4,969,830 A | * | 11/1990 | Daly et al. | 439/136 |
| 5,694,292 A | * | 12/1997 | Paulsel et al. | 361/686 |
| 5,933,322 A | * | 8/1999 | Ruch et al. | 361/686 |
| 6,069,790 A | * | 5/2000 | Howell et al. | 361/686 |
| 6,115,242 A | | 9/2000 | Lambrecht | |
| 6,123,557 A | | 9/2000 | Wang et al. | |
| 6,135,801 A | | 10/2000 | Helot et al. | |

* cited by examiner

*Primary Examiner*—Tuyen T Nguyen
(74) *Attorney, Agent, or Firm*—Thorpe North & Western LLP

(57) ABSTRACT

A constant force apparatus having a cam (12) with a non-planar surface (13), a compliant member (14) with a free end (18), a fixed end (16), and an intermediate contact area (20) therebetween, wherein the free end (18) of the compliant member (14) (slidably engages the non-planar surface (13) of the cam (12) and the compliant member (14) provides a substantially constant reaction force at the intermediate contact area (20) regardless of displacement (22) of the intermediate contact area (20). The compliant member (14) can further include a material capable of conducting electricity for use as an electrical contact. The apparatus can further comprise a docking station for use with a dockable unit to accept the dockable unit and provide an electrical connection thereto.

30 Claims, 3 Drawing Sheets

CONSTANT FORCE APPARATUS AND METHOD

This application claims benefit of Provisional Appl. No. 60/256,030 filed Dec. 15, 2000.

BACKGROUND OF THE INVENTION

1. Field of the Invention

The present invention relates generally to a method and apparatus for delivering a substantially constant reaction force in response to an applied displacement, regardless of the magnitude or change of the displacement.

2. Related Art

Many industrial applications can benefit by a device in which a substantially constant force is output in response to a varied, applied displacement input. Such devices apply a constant force in applications where the unit applying the force does not maintain a constant distance from the unit to which the force is applied. While simple to describe and understand, the concept of constant force application is not easily executed in practice. Most conventional materials and devices follow a typical force/displacement relationship: as the displacement applied to a particular body increases, the force increases correspondingly. This common relationship can, perhaps, best be understood by analyzing the traditional mechanics which describe the relationship between force and deflection of springs. The force (F) applied to a spring is proportional to the distance the spring is deflected (d) and the "spring constant," k, illustrated by the well known equation F=kd. Although the spring constant may vary from one spring to the next, a conventional spring will typically output more force as the input displacement is increased. Conversely, as a displacement applied to a spring is decreased, the force output of the spring will decrease. Most naturally occurring materials exhibit the same response to an applied displacement: as the displacement increases, i.e., as the material is compressed, the force required to continue compressing the material increases proportionally. This relationship holds for most materials in an un-yielded state.

Despite these complexities, constant force devices have been developed. One field where constant force devices have been used is the field of materials testing. Manufacturing or developmental materials are frequently subjected to mechanical testing to determine the mechanical properties of the materials. Often materials must be qualified by undergoing a testing matrix before they can be used in production. Such testing often requires that the materials undergo constant stress testing. In order to perform such testing, machines were developed that sense the force applied to a material and adjust the displacement applied to the material in order to maintain a constant force. Similar machines have been developed to perform wear testing, a process by which a constant abrasion force is applied to a material over a period of time. Because the material abrades during the test, the abrasion force applicator must move in order to maintain contact with the material. Regardless of the required movement, the abrasive force applicator must maintain a constant force.

The machines developed for these tests are capable of precisely applying a uniform force, regardless of varying displacements, but are very sophisticated and require many components and relatively large spaces to operate. They usually include a force sensing and feedback control system in addition to the test hardware, making the constant force devices impractical for smaller applications and generally very expensive. The large expense associated with such devices is prohibitive in many fields where constant force devices are otherwise very desirable.

Because of these considerations, when a constant force device is required in smaller or simpler operations, the constant force device is often simulated using non-constant force devices and compensating for the variable force reactions. Such simulated devices often utilize conventional springs, which, as explained above, are not constant force devices. While constant force tension springs have been developed, it is believed that constant force compression springs have, to date, only been simulated with negligible success. Use of conventional compression springs as constant force simulators has led to many problems. For example, most motor brushes are equipped with springs that serve to maintain contact between the brushes and the rotor. Ideally, the brushes would exert a constant force on the rotor. However, as the brushes wear, the springs extend to compensate for the lost brush material. The springs are consequently extended beyond their initial displacement. As illustrated by the formula F=kd, the springs at this point are applying a force different than the originally applied force due to the difference in extension. Variations in spring forces can adversely affect the performance of the motors and can lead to uneven wear and premature failure of the brushes.

Another example where constant force devices are desirable is in the field of electrical contacts. The reliability of high-cycle electrical contacts is of great concern to designers. The factor that contributes most to the reliability of an electrical contact is the contact surface mating conditions. Two parameters most affect mating conditions, surface finish and contact normal force at mating. When contact normal force is maintained above a certain level, greater reliability is obtained. Contact normal forces must be small enough to minimize plating damage over the life of the contact, but must be large enough to overcome co-planarity differences and other geometric variations. Thus, a desirable electric contact would maintain a constant, optimal contact force regardless of variations in deflection due to assembly or use.

Conventional electrical contacts attempt to simulate this constant, optimal force by the use of conventional springs. Common examples include pogo type connectors and cantilever type connectors, both of which employ compression springs. While the type of spring used by these connectors differs, the objective is the same. The springs are selected in an effort to provide a constant reaction force at the electrical contact point. Due to the inherent limitations of conventional springs, however, the optimal force cannot be maintained through a range of displacements. To compensate for this, very tight assembly and use tolerances are established, as the designers of the connectors must ensure that contact is made with the spring only in a narrow range of the spring's travel. In this manner, a relatively constant force is maintained at the contact point, but considerable and costly restraints are imposed during assembly. Also, such simulated constant force contacts are not suitable in environments where vibration and movement are present. Applications such as airplanes, vehicles and heavy equipment require electric connectors that can maintain a constant contact force even in the presence of vibration and relative movement of parts.

SUMMARY OF THE INVENTION

It has been recognized that it would be advantageous to develop a constant force method and apparatus of simple construction that produces a constant reaction force in response to an applied displacement. In addition, it has been recognized that it would be advantageous to develop an electrical contact that provides a substantially constant force. In addition, it has been recognized that it would be advantageous to develop a docking station for use with a dockable unit with a substantially constant contact force.

The invention provides a constant force apparatus having a cam with a non-planar surface; a compliant member with a free end, a fixed end, and an intermediate contact area therebetween. The free end of the compliant member slidably engages the non-planar surface of the cam and the compliant member continuously provides a substantially constant reaction force at the intermediate contact area regardless of magnitude or change of displacement of the intermediate contact area.

In accordance with a more detailed aspect of the present invention, the compliant member can include a flexible beam wherein the flexible beam is shaped to have a first curved section extending from the fixed end away from the cam and curving back toward the cam, a second curved section extending from the first curved section in an opposite curve away from the cam, and a third curved section, including the intermediate contact point, extending from the second curved section and curving back down toward the cam surface. The compliant member can also include a spring and can include a material capable of conducting electricity In accordance with a more detailed aspect of the present invention, the non-planar cam surface can be arcuate or can be a curved spline.

In accordance with a more detailed aspect of the present invention, the apparatus includes an electrical contact having a cam with a non-planar surface and a compliant member capable of conducting electricity which has a free end, a fixed end, and an intermediate contact area therebetween. The free end of the compliant member slidably engages the non-planar surface of the cam and the compliant member continuously provides a substantially constant reaction force at the intermediate contact area regardless of magnitude or change of displacement of the contact area.

In accordance with a more detailed aspect of the present invention, the apparatus can be a first electrical contact associated with a first device and configured to connect with a second electrical contact of a second device. The first electrical contact includes a cam, disposed on the first device and having a non-planar surface. A compliant member is disposed on the first device proximate the cam, is capable of conducting electricity, and has a fixed end, to be fixed to the first device, a free end slidably engaging the non-planar surface of the cam, and an intermediate contact area between the free and fixed ends to engage the second electrical contact of the second device to allow the flow of electricity between the second electrical contact of the second device and the fixed end of the compliant member. The compliant member deflects through at least two different positions, including an undeflected position in which the free end of the compliant member contacts a first location of the surface of the cam and a deflected position in which the free end of the compliant member contacts a different second location of the surface of the cam. The compliant member is capable of continuously applying a substantially constant reaction force as the compliant member deflects from the undeflected position to the deflected postion.

In accordance with a more detailed aspect of the present invention, the apparatus can be a docking station for use with a dockable unit which includes a receptacle disposed in the docking station and configured to receive at least a portion of the dockable unit and a printed circuit board disposed in the docking station. The docking station includes a cam disposed in the docking station and having a non-planar surface and a compliant member disposed on the printed circuit board and electrically coupled thereto. The compliant member is capable of conducting electricity and has a fixed end fixed to the printed circuit board and capable of conducting electricity thereto, a free end slidably engaging the surface of the cam, and an intermediate contact area between the fixed and free ends and extending into the receptacle of the docking station. The intermediate contact area is engagable with the dockable unit when the dockable unit is disposed in the receptacle and the compliant member deflects through at least two different positions, including an undeflected position in which the free end of the compliant member contacts a first location of the surface of the cam when the dockable unit is removed from the receptacle of the docking station and a deflected position in which the free end of the compliant member contacts a different, second location of the surface of the cam when the dockable unit is disposed in the receptacle of the docking station. The compliant member is capable of continuously applying a substantially constant reaction force to the dockable unit as the dockable unit engages the intermediate contact area of the compliant member.

In accordance with a more detailed aspect of the present invention, the invention provides a method for providing a constant reaction force between a first, fixed component and a second, movable component. The method includes the steps of coupling the fixed component to a base surface, coupling a cam with a non-planar surface to the base surface, and providing the fixed component with a compliant member which has a free end in slidable contact with the non-planar surface, a fixed end fixed to the base surface, and an intermediate contact point therebetween. The method further includes the steps of advancing the movable component into contact with the intermediate contact point of the fixed component and forcing the free end of the compliant member along the surface of the non-planar surface of the cam by displacing the compliant member with the movable component. The compliant member continuously produces a substantially constant reaction force in response to the displacement of the intermediate contact point, regardless of magnitude or change of the displacement of the intermediate contact point.

Additional features and advantages of the invention will be apparent from the detailed description which follows, taken in conjunction with the accompanying drawings, which together illustrate, by way of example, features of the invention.

DETAILED DESCRIPTION

Figure 1A:
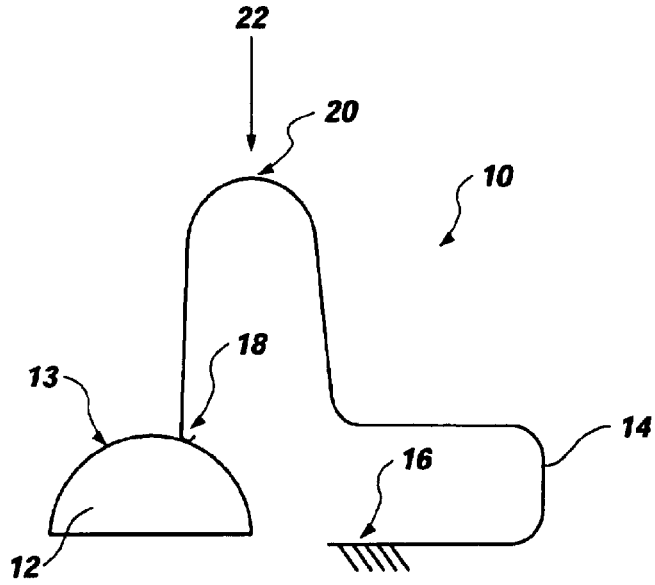
FIG. 1*a* is a graphic side view of a constant force apparatus in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 1B:
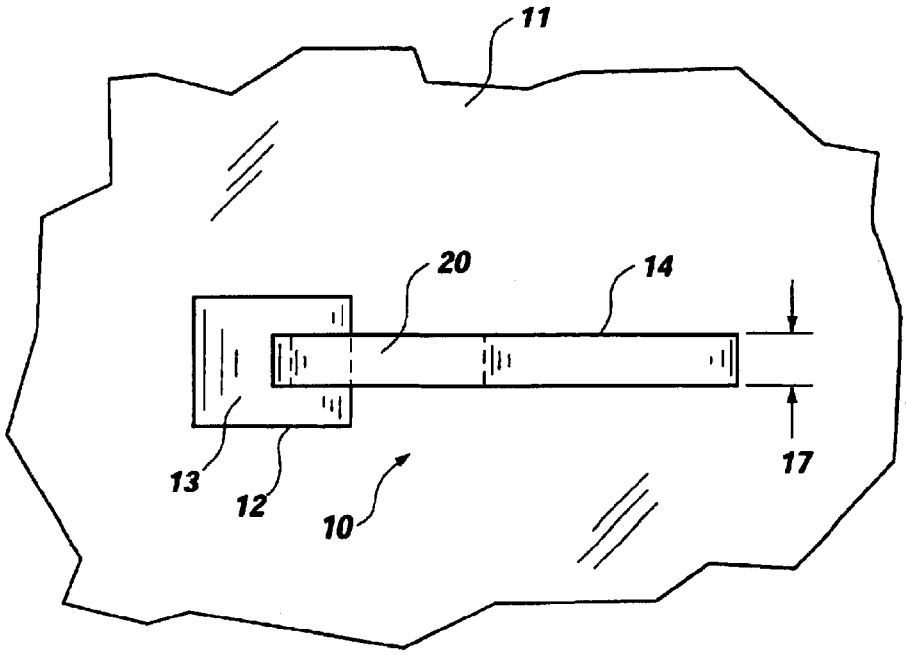
FIG. 1*b* is a top view of the constant force apparatus shown in FIG. 1*a*.

As illustrated in FIGS. 1*a* and 1*b*, a constant force apparatus, indicated generally at 10, in accordance with the present invention is shown for providing a substantially constant force. The apparatus can be used, in one embodiment, as a constant force compression device. Electrical contacts and docking stations are examples of fields that may benefit from the use of such a constant force apparatus.

The apparatus 10 includes a cam 12 having a non-planar cam surface 13. In addition, the apparatus 10 includes compliant member 14 having a fixed end 16, a free end 18 and an intermediate contact area 20 for engaging a moveable object or contacting surface which applies a displacement force 22. The free end 18 of the compliant member 14 responds to this force and slidably engages the non-planar surface 13 of the cam 12. As illustrated in FIG. 1*b*, the apparatus 10 has a width 17 and can be made more or less narrow as required by a particular application. The compliant qualities of the compliant member 14 can be controlled for each unique application by adjusting the width of the member, as well as by altering the shape or thickness of the compliant member.

Figure 1C:
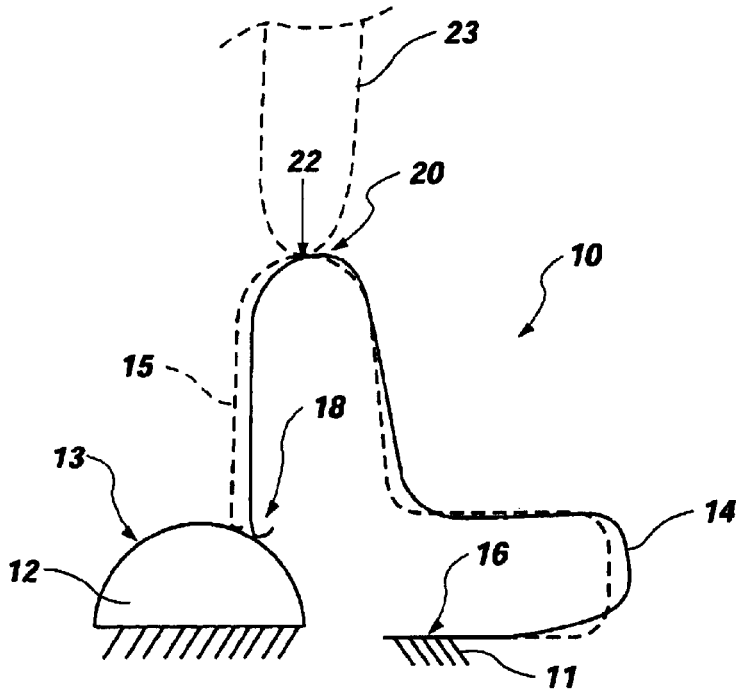
FIG. 1*c* is a side view of the constant force apparatus of FIG. 1*a*, after displacement of a compliant mechanism.

As shown by FIG. 1*c*, as a force 22 is applied at the intermediate contact area 20, the free end 18 of the compliant member 14 slides along the cam surface 13. The dashed line 15 indicates the original position of the compliant member, prior to application of the displacement force. The compliant member 14 serves as a strain storage device, much like a traditional spring. As such, acting on its own, it would produce an increasingly larger reaction force in response to the applied displacement force as the displacement increased. However, by allowing the free end 18 of the compliant member 14 to follow the path of the non-planar cam surface 13, a mechanical advantage is obtained. As the stored strain energy increases in the compliant member, which would normally lead to higher reaction forces, the free end 18 slides along the surface 13 of the cam 12 and allows for more input force on the compliant mechanism. The combination of the strain energy storage and mechanical advantage produce an apparatus and method for providing a substantially constant reaction force in response to the applied displacement. As used herein, the term "substantially constant reaction force" shall mean a reaction force within +/−40% of a predetermined, desired reaction force. To further narrow the range of the substantially constant reaction force, a small pre-load may be applied to the compliant member to overcome any inertial forces present at zero deflection. This small pre-load would be considered to be within the description of an "undeflected position."

It will be appreciated that the geometries of the compliant member 14 and the cam surface 13 are interrelated. Optimization can be used to determine the correct geometry and spring constants that balance the mechanical advantage and the strain energy storage. The shapes of the cam and compliant member are not limited to the embodiment shown in FIGS. 1*a*–1*c*, but can take many forms which interrelate to each other. For instance, the compliant member may include a flexible beam, such as an elongated linear or curved strip of flexible or resilient material capable of deflecting or bending. In addition, the compliant member can include a spring, such as a leaf or coil spring. Furthermore, the compliant member can be any shape which provides compliance for the storage of strain energy. Similarly, the surface 13 of the cam 12 can have various shapes, as described in greater detail below.

One example of an application that can benefit from such an apparatus is the general field of electrical contacts. The reliability of high-cycle electrical contacts is of great to concern to designers. The factor that contributes most to the reliability of an electrical contact is the contact surface mating condition. Two significant parameters which affect mating conditions are surface finish and "contact normal force" at mating. When contact normal force is maintained above a certain level, greater reliability is obtained. Contact normal forces must be small enough to minimize plating damage over the life of the contact, but must be large enough to overcome co-planarity differences and other geometric variations. Thus, a desirable electric contact would maintain a constant, optimal contact force regardless of variations in deflection due to assembly or use.

It will be appreciated that the apparatus of the present invention provides a constant reaction force assembly ideal for use as an electrical contact. Thus, the compliant member 14 can include a material capable of conducting electricity, or can itself be formed of a conductive material, such as copper, etc. The fixed end 16 can be soldered, or otherwise electrically coupled, to a printed circuit board or other electrical connection. The cam surface 13 or the free end 18 can be made of, or covered by, a non-conductive material to ensure that electricity flows only through the fixed end 16. An external device or contact, shown in FIG. 1*c*, can engage the intermediate contact area 20 and apply a force 22, as shown. Because the constant force apparatus 10 can apply a substantially constant reaction force against the external device, the contact normal force between the two is maintained at a substantially constant, optimal level, regardless of the magnitude or change of the displacement. Once contact is made, electricity or electrical signals can flow to and from the external device through the compliant member 14 and to and from the fixed end 16.

Because the present invention involves few and relatively simple components, manufacturing and assembly the apparatus can be done inexpensively and efficiently. Because the reaction force is substantially constant regardless of displacement, normally tight assembly tolerances can be relaxed, as an optimal normal contact force is maintained throughout the travel of the compliant member. Also, the constant force apparatus can be made very small, for use in a wide range of electrical devices which require small package size. Furthermore, the present invention, when used as an electrical contact device, can be used in applications where a large degree of vibration and movement occur. Since the contact normal force remains substantially constant, optimal mating conditions are maintained regardless of the magnitude or change of the displacement of the compliant member. Such an electrical contact can be used as a connector in aircraft, vehicles and machinery, where vibration and relative movement of parts is difficult to control.

Figure 1D:
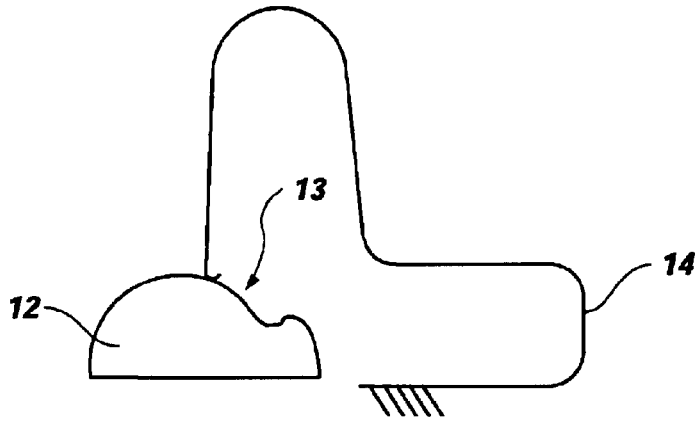
FIG. 1*d* is a side view of an alternate embodiment of the constant force apparatus of FIG. 1*a;*

The free end 18 of the compliant member 14 can be shaped in a curve to facilitate the slidable contact between the free end and the cam surface 13. Alternately, the free end 18 can be straight or shaped otherwise, and can be coated with a low-friction material. The cam surface can be made of a low-friction material, such as polypropylene or Teflon®. The cam 12 and the fixed end 16 of the compliant member, neither of which need move, can be mounted on a surface 11, shown in FIG. 1*b*. Alternately, the cam and the fixed end can be mounted on separate surfaces. In a preferred embodiment, the non-planar surface of the cam comprises a half-circle shape, as illustrated in FIGS. 1*a* through 1*c*. The non-planar surface of the cam can also be of other arcuate shapes or can be shaped as a curved spline, as illustrated in FIG. 1*d*. As used herein, the term "curved spline" is used broadly to describe an elongated member with at least a curved portion, and which may include multiple curves and/or straight portions as well.

Figure 2:
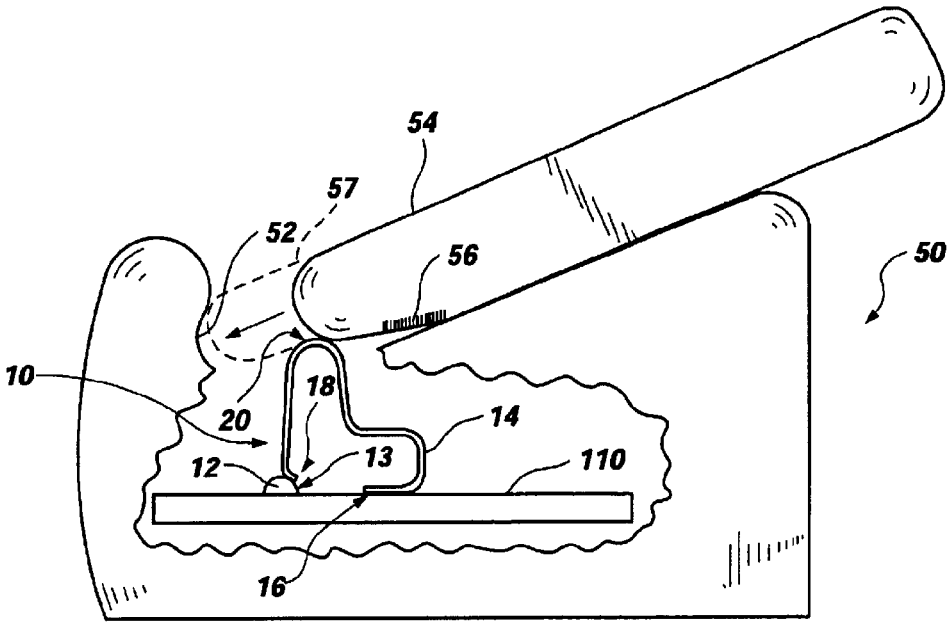
FIG. 2 is a side cutaway view of another embodiment of a constant force apparatus, as utilized as a docking station.

Referring to FIG. 2, the apparatus 10 of FIGS. 1*a* through 1*d* can be used with a docking station 50, which can include all of the advantages described above. The compliant member 14 and the cam 12 can be mounted on surface 110, which can be part of a printed circuit board or other electrical connection. The compliant member 14 can be soldered to the printed circuit board at the fixed end 16, providing both an attachment point for the compliant member and an electrical connection to the printed board. A receptacle 52 is configured to accept at least a portion of a dockable unit 54. The dockable unit 54 can be a personal digital assistant (PDA) for use with a PDA docking station, which facilitates communication between the PDA and peripheral components. The docking station 54 can also be used to dock notebook computers or rechargeable devices. Other examples of dockable units include cordless phones, cell phones, digital cameras, CD, MP3 or other portable music players, rechargeable batteries, computer memory cards or cartridges, PC cards such PCMCIA cards or the like, memory chips, memory chips such as flash RAMs, game cartridges, PC cards, hard drives or other memory devices, etc.

As shown in FIG. 2, the dockable unit 54 is docked into the docking station 50 and a second connection 56 thereof engages the intermediate contact area 20 of the compliant member 14 when fully nested (see 57). The compliant member 14 provides a path for conducting electricity from the second connection 56 to the printed circuit board. As the second connection 56 engages the intermediate contact area 20, the compliant member 14 is displaced and the free end 18 slides along the cam surface 13. It will be appreciated that, once docked, the compliant member 14 advantageously provides a substantially constant reaction force against the second connection 56. The contact between the second connection 56 and the compliant member 14 or contact area 20 can be used to transfer data, for instance, when synchronizing two machines. Alternately, the contact can be used to transfer electricity for charging a device.

Figure 3:
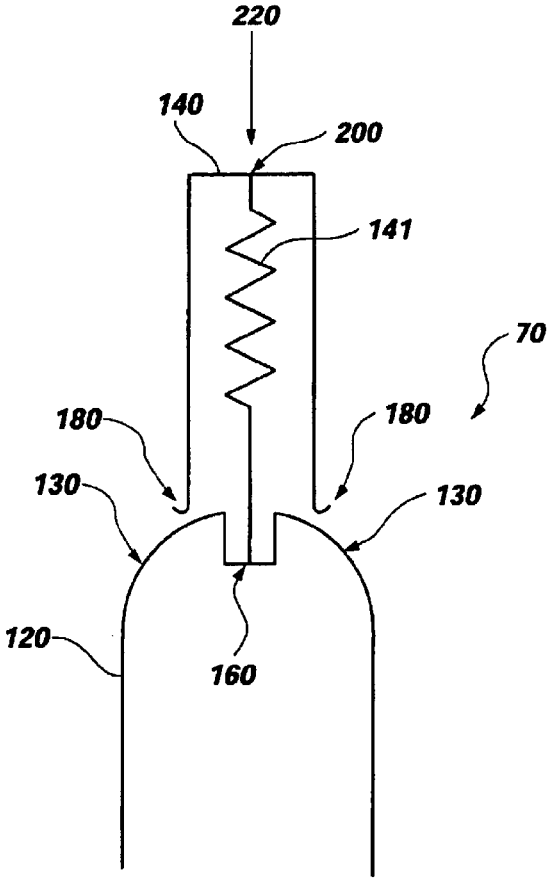
FIG. 3 is a graphic side view of another embodiment of a constant force apparatus in accordance with the present invention.

FIG. 3 illustrates another embodiment of a constant force apparatus, shown generally at 70, in accordance with the present invention. In this embodiment, a cam 120 includes two non-planar cam surfaces 130. A compliant member 140 includes a fixed end 160, which can be fixed to the cam 120 or to another surface (not shown). The compliant member 140 may also include a secondary compliant element or spring 141 to provide compliance. The compliant member 140 can include two free ends 180 which slidably engage the cam surfaces 130. As a displacement is applied to the compliant member at 220, the free ends 180 slide along the cam surfaces 130 and the apparatus 70 provides a substantially constant reaction force at the contact area 200.

The present invention is not limited to use as an electrical connector. Many industrial applications can benefit from such an apparatus. For instance, rather than using conventional springs to retain contact between the brushes and rotor in an electric motor, the present invention can be used to advantageously maintain a constant force between the brushes and rotor. The present invention can thus simplify design choices and extend the life of brushes and rotors. As another example, the present invention can be used in material testing when it desired to maintain a constant force between the testing equipment and material to be tested, regardless of changes in deflection of the material or equipment. Any application that requires a constant reaction in response to an applied displacement can benefit from the present invention.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A constant force apparatus, comprising:

a) a cam having a non-planar surface;

b) a compliant member having a free end, a fixed end, and an intermediate contact area therebetween;

c) the free end of the compliant member slidably engaging the non-planar surface of the cam; and d) the compliant member continuously providing a substantially constant reaction force at the intermediate contact area regardless of magnitude or change of displacement of the intermediate contact area.

2. A constant force apparatus as in claim 1, wherein the compliant member includes a flexible beam.

3. A constant force apparatus as in claim 2, wherein the flexible beam is shaped to have:

a) a first curved section extending from the fixed end away from the cam and curving back toward the cam;

b) a second curved section extending from the first curved section in an opposite curve away from the cam; and c) a third curved section, including the intermediate contact point, extending from the second curved section and curving back down toward the cam surface.

4. A constant force apparatus as in claim 1, wherein the compliant member includes a spring.

5. A constant force apparatus as in claim 1, wherein the non-planar cam surface is arcuate.

6. A constant force apparatus as in claim 1, wherein the non-planar cam surface is a curved spline.

7. A constant force apparatus as in claim 1, wherein the compliant member includes a material capable of conducting electricity.

8. An electrical contact apparatus, comprising:

a) a cam having a non-planar surface;

b) a compliant member capable of conducting electricity and having a free end, a fixed end, and an intermediate contact area therebetween;

c) the free end of the compliant member slidably engaging the non-planar surface of the cam; and d) the compliant member continuously providing a substantially constant reaction force at the intermediate 9. An electrical contact apparatus as in claim 8, wherein the compliant member includes a flexible beam.

10. An electrical contact apparatus as in claim 8, wherein the compliant member includes a spring.

11. An electrical contact apparatus as in claim 8, wherein the non-planar cam surface is arcuate.

12. An electrical contact apparatus as in claim 8, wherein the non-planar cam surface is a curved spline.

13. A first electrical contact associated with a first device and configured to connect with a second electrical contact of a second device, the first electrical contact comprising:

a) a cam, configured to be disposed on the first device, and having a non-planar surface;

b) a compliant member, configured to be disposed on the first device proximate the cam, capable of conducting electricity, and having:

i) a fixed end, configured to be fixed to the first device;

ii) a free end, slidably engaging the non-planar surface of the cam;

ii) an intermediate contact area, between the free and fixed ends, configured to engage the second electrical contact of the second device and to allow the flow of electricity between the second electrical contact of the second device and the fixed end of the compliant member;

c) the compliant member deflecting through at least two different positions, including:

i) a substantially undeflected position in which the free end of the compliant member contacts a first location of the surface of the cam; and ii) a deflected position in which the free end of the compliant member contacts a different second location of the surface of the cam; and d) the compliant member being capable of continuously applying a substantially constant reaction force as the compliant member deflects from the undeflected position to the deflected position.

14. A first electrical contact as in claim 13, wherein the compliant member includes a flexible beam.

15. A first electrical contact as in claim 13, wherein the compliant member includes a spring.

16. A first electrical contact as in claim 13, wherein the non-planar surface of the cam is arcuate.

17. A first electrical contact as in claim 13, wherein the non-planar surface of the cam is a curved spline.

18. A first electrical contact as in claim 13, wherein the compliant member includes a material capable of conducting electricity.

19. A docking station for use with a dockable unit, the docking station comprising:

a) a receptacle, disposed in the docking station and being configured to receive at least a portion of the dockable unit;

b) a printed circuit board, disposed in the docking station;

c) a cam, disposed in the docking station and having a non-planar surface;

d) a compliant member, disposed on the printed circuit board and electrically coupled thereto, the compliant member being capable of conducting electricity and having:

i) a fixed end, fixed to the printed circuit board and capable of conducting electricity thereto;

ii) a free end, slidably engaging the surface of the cam; and iii) an intermediate contact area, between the fixed and free ends and extending into the receptacle of the docking station and engagable with the dockable unit when the dockable unit is disposed in the receptacle; and e) the compliant member deflecting through at least two different positions, including:

i) an undeflected position in which the free end of the compliant member contacts a first location of the surface of the cam when the dockable unit is removed from the receptacle of the docking station; and ii) a deflected position in which the free end of the compliant member contacts a different second location of the surface of the cam when the dockable unit is disposed in the receptacle of the docking station; and f) the compliant member being capable of continuously applying a substantially constant reaction force to the dockable unit as the dockable unit engages the intermediate contact area of the compliant member.

20. A docking station as in claim 19, wherein the compliant member includes a flexible beam.

21. A docking station as in claim 19, wherein the compliant member includes a spring.

22. A docking station as in claim 19, wherein the non-planar surface of the cam is arcuate.

23. A docking station as in claim 19, wherein the non-planar surface of the cam is a curved spline.

24. A docking station as in claim 19, wherein the compliant member includes a material capable of conducting electricity.

25. A method for providing a constant reaction force between a first, fixed component and a second, movable component, comprising the steps of:

a) coupling the fixed component to a base surface;

b) coupling a cam with a non-planar surface to the base surface;

c) providing the fixed component with a compliant member having a free end in slidable contact with the non-planar surface, a fixed end fixed to the base surface, and an intermediate contact point therebetween;

d) advancing the movable component into contact with the intermediate contact point of the fixed component; and e) forcing the free end of the compliant member along the surface of the non-planar surface of the cam by displacing the compliant member with the movable component, the compliant member continuously producing a substantially constant reaction force in response to the displacement of the intermediate contact point, regardless of magnitude or change of the displacement of the intermediate contact point.

26. A method in accordance with claim 25, further comprising the step of forming the compliant member from a flexible beam.

27. A method in accordance with claim 25, further comprising the step of forming the compliant member from a spring.

28. A method in accordance with claim 25, further comprising the step of forming the non-planar surface of the cam in an arcuate shape.

29. A method in accordance with claim 25, further comprising the step of forming the non-planar surface of the cam in a curved spline.

30. A method in accordance with claim 25, further comprising the step of forming the compliant member from a material capable of conducting electricity. contact area regardless of magnitude or change of displacement of the contact area.

* * * * *